US009114437B2

(12) United States Patent
Isenberg et al.

(10) Patent No.: US 9,114,437 B2
(45) Date of Patent: Aug. 25, 2015

(54) MANWAY FOR FOOD PROCESSING EQUIPMENT

(75) Inventors: Timothy J. Isenberg, Marshfield, WI (US); John E. Zirbel, Marshfield, WI (US)

(73) Assignee: Cheese & Whey Systems, Inc., Marshfield, WI (US)

( * ) Notice: Subject to any disclaimer, the term of this patent is extended or adjusted under 35 U.S.C. 154(b) by 1164 days.

(21) Appl. No.: 13/089,052

(22) Filed: Apr. 18, 2011

(65) Prior Publication Data

US 2011/0252980 A1 Oct. 20, 2011

Related U.S. Application Data

(60) Provisional application No. 61/325,612, filed on Apr. 19, 2010.

(51) Int. Cl.

| | |
|---|---|
| ***B08B 9/00*** | (2006.01) |
| ***B01F 7/02*** | (2006.01) |
| ***B01F 7/04*** | (2006.01) |
| ***B08B 9/093*** | (2006.01) |

(52) U.S. Cl.

CPC . *B08B 9/00* (2013.01); *B01F 7/022* (2013.01); *B01F 7/042* (2013.01); *B08B 9/093* (2013.01)

(58) Field of Classification Search

CPC ..... B08B 9/00; B08B 9/093; B01F 7/042; B01F 7/022

USPC ..... 366/138

See application file for complete search history.

(56) References Cited

U.S. PATENT DOCUMENTS

| | | | |
|---|---|---|---|
| 4,989,504 | A | 2/1991 | Jay |
| 5,218,784 | A | 6/1993 | Pollock |
| 6,257,129 | B1 | 7/2001 | Sipma et al. |
| 6,367,375 | B2 | 4/2002 | Sipma et al. |
| 6,418,836 | B2 | 7/2002 | Sipma et al. |
| 6,539,845 | B2 | 4/2003 | Sipma et al. |
| 2007/0277680 | A1 | 12/2007 | van der Meulen |
| 2008/0127834 | A1 | 6/2008 | Bokelmann et al. |
| 2008/0131313 | A1 | 6/2008 | Bokelmann et al. |

*Primary Examiner* — Lore Jarrett

(74) *Attorney, Agent, or Firm* — Boyle Fredrickson, S.C.

(57) ABSTRACT

A manway is provided that can be used with food processing equipment. The manway may be provided at an intersection of a top wall and an end or side wall of the food processing equipment. The manway may extend angularly with respect to the food processing equipment so that a passage extending through the manway extends into an inside space of the food processing equipment at an angle. A nozzle may be mounted so as to position an opening(s) of the nozzle in a direction that faces the passage of the manway, and the nozzle may deliver a cleaning fluid so that the manway can be automatically cleaned in place.

13 Claims, 8 Drawing Sheets

MANWAY FOR FOOD PROCESSING EQUIPMENT

CROSS-REFERENCE TO RELATED APPLICATIONS

This application claims priority from U.S. Provisional Patent Application Ser. No. 61/325,612 filed on Apr. 19, 2010, the entirety of which is expressly incorporated by reference herein.

BACKGROUND OF THE INVENTION

1. Field of the Invention

The invention relates to food processing equipment and, more particularly, to manways for use with food processing equipment.

2. Discussion of the Related Art

Manways that allow technicians to enter interiors of enclosed food processing equipment are known.

Clean-in-place systems for use with food processing equipment are also known in the food processing industries. Typically, such clean-in-place systems automatically spray cleaning fluid inside of the food processing equipment.

SUMMARY OF THE INVENTION

The inventors have recognized that prior art manways that permit access to interiors of enclosed food processing equipment through side or end walls may be splashed with vat contents during use and may develop leaks over time. The inventors have further recognized that prior art manways that permit access to interiors of enclosed food processing equipment through top walls require technicians to climb entirely on top of the vat which may be tiring and time-consuming, which may lead to performing visual inspections through such manways and/or entering the food processing equipment for manual inspections of components less frequently than may be desirable. The inventors have also recognized that perimeter ring-seals that are used in food processing equipment require tools for removal, which can be time-consuming, and that using tools may damage seating surfaces of the seals, which may compromise the integrity of the seal interface. The inventors have also recognized that lids or covers of prior art manways can be difficult to move for accessing the manway because they are large and heavy. The inventors have further recognized that prior art clean-in-place systems used for food processing equipment have been primarily designed to clean the inside walls of the equipment and large mechanical components that are housed in the equipment, such as agitator shafts, while other parts of the equipment have not been cleaned with these prior art clean-in-place systems. The inventors have also recognized that in prior art clean-in-place systems, manways must be manually cleaned by technicians and, at times, doing so can be substantially time-consuming. The present invention contemplates a manway that addresses these and other inventor-identified problems and drawbacks of the prior art.

In accordance with an aspect of the invention, a manway is provided that may be used with a food processing vat system, which may include vats and/or other enclosed food processing machines. The manway includes interconnected side walls that define a passage therebetween. The manway may be connected to a vat so that the passage of the manway extends into an inside space of the vat. A nozzle may be provided that is configured to convey a cleaning fluid therethrough, and the nozzle may be mounted to at least one of the manway and the vat. The nozzle may have an opening that is positioned with respect to the manway so as to direct the cleaning fluid into the manway. The nozzle may be positioned at least partially within the passage of the manway. This may allow the manway to be cleaned in place, without requiring manual cleaning by a technician.

In accordance with another aspect of the invention, the manway is arranged angularly, which may be non-orthogonally or non-parallel, with respect to the vat so that the passage extends angularly into the inside space of the vat. The manway may be provided at an upper end of the vat, and may be connected to the vat at an intersection defined between the top wall of the vat and an end wall of the vat and/or a side wall of the vat. This may position the manway so that it is contacted by a relatively small amount of vat contents during use of the vat and may allow a technician to visually inspect the inside space of the vat without climbing on top of the vat.

In accordance with another aspect of the invention, the manway includes a cover or lid that defines a closed position in which the passage is covered and an open position in which the passage in uncovered, and a stop that is connected to the lid for holding the lid in the open position. The stop may hold the lid in the open position so that the lid is situated generally orthogonally with respect to the top wall of the vat, in which the lid may be in a generally vertical position. The lid may include a latch that biases toward a locked position in which the latch locks the lid in the closed position. A movable handle may be connected to the latch for actuating the latch to an unlocked position in which the lid may be moved from the closed to the open position. The lid may include a spring hinge that assists in lifting of the lid from the closed to the open position. The stop may be cantilevered from the lid and extend outwardly beyond the spring hinge so that the stop provides a counter-weight to the lid that assists in pivoting or lifting the lid between the closed and open positions. This may allow a technician to lock, unlock, raise, and lower the lid with a single hand despite a relatively large size and heavy weight of the lid.

In accordance with another aspect of the invention, a replaceable seal is provided between the lid and the interconnected walls of the manway. The seal may be seated in a groove that extends into an upper perimeter surface of the interconnected walls that extend around the passage. A recess may extend into the upper perimeter surface of the interconnected walls and connect to the groove to accommodate manual tool-less removal of the seal from the manway.

Various other features, objects, and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
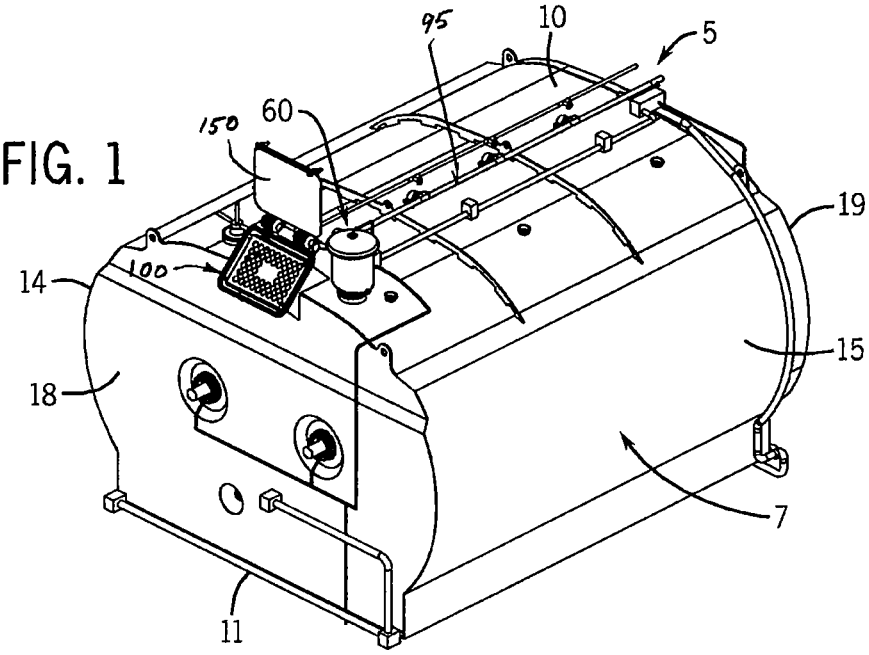
FIG. 1 is an isometric view from above and in front of a vat system incorporating a manway in accordance with the present invention.
Figure 2:
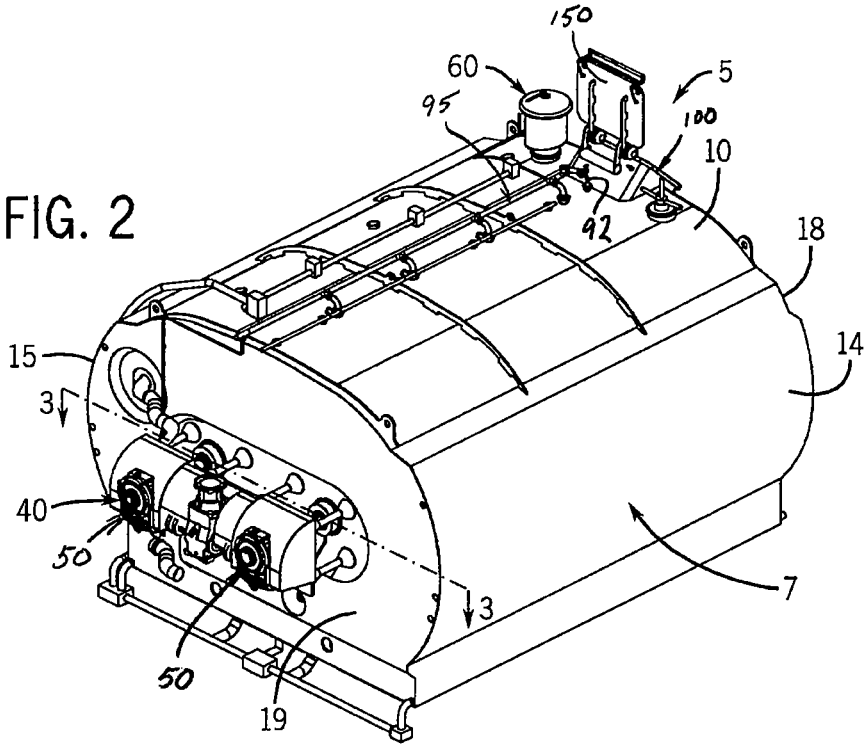
FIG. 2 is an isometric view from above and in back of the vat system of FIG. 1.
Figure 3:
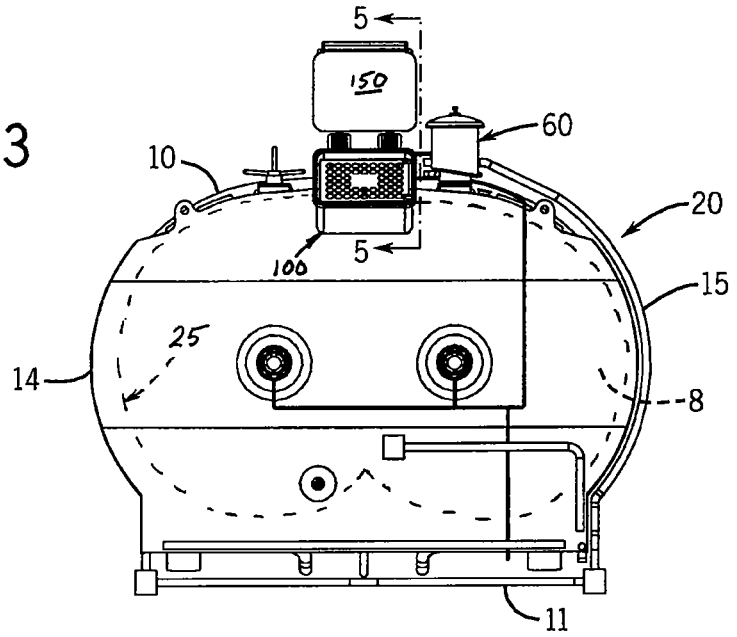
FIG. 3 is a front elevation view of the vat system of FIG. 1.
Figure 4:
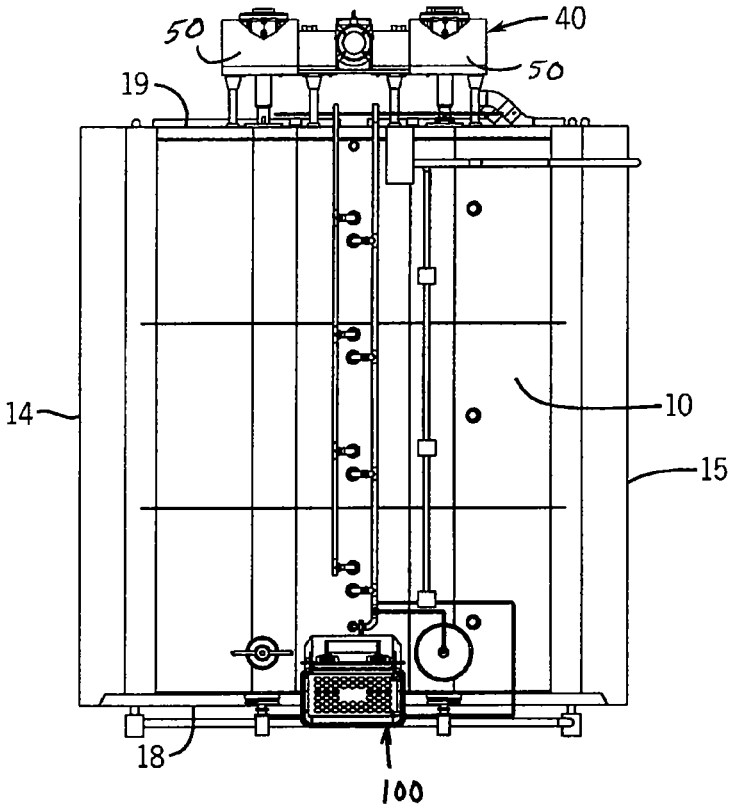
FIG. 4 is a top plan view of the vat system of FIG. 1.

FIG. 1 illustrates a manway 100 being implemented within a vat system 5. Vat system 5 can be used for processing food and related products. The manway 100 is described as being used in the vat system 5 to simplify its explanation, while noting that the manway 100 in other embodiments may be implemented in various other enclosed food processing machines, and/or other suitable machines having enclosures that require technicians to enter, or through which visual inspections may need to be performed.

Referring now to FIGS. 1-4, vat system 5 can be used for processing the food and related products (collectively referred to as "vat contents") by mechanically manipulating and heating or cooling the vat contents, depending on the particular food or related product being processed. In a representative application, the vat system 5 may be used in the production of cheese, although it is understood that the vat system 5 may be used in processing other types of food products. The system 5 includes a vat 7 that has an agitation system 40 which performs the mechanical manipulations tasks by using a motor that delivers power to a pair of drives 50 (FIG. 2) to rotate a pair of shafts upon which blade assemblies are mounted, and a zoned heat transfer system to perform such heating and/or cooling to provide zoned temperature control to the vat 7.

Vat 7 defines an enclosure having a top wall 10, a bottom wall 11, and side walls 14, 15, all of which extend longitudinally between a pair of end walls 18 and 19. The walls 10, 11, 14, 15, 18, 19 are multilayered, having an outer jacket 20 and an inner shell 25 that are spaced from each other. Insulation and various components of the zoned heat transfer system are housed between the jacket 20 and shell 25. The shell 25 is the inmost structure of the vat 7, so that its inner surface surrounds and defines an outer periphery of a void or inside space 8 within the vat 7. A lower part of the inside space 8 resembles two horizontal parallel cylinders that transversely intersect each other, being defined by a lower portion of the shell 25 that has a pair of arcuate depressions which extend along the length of the vat 7, on opposing sides of a longitudinally extending raised middle segment. From the lower portion of the shell 25, opposing side portions extend in an outwardly bowed manner, arching away from each other in a transverse direction of the vat 7. An upper portion of the shell 25 arcs gradually between side portions of the shell 25 and defines an upper perimeter of the inside space 8 of vat 7.

Figure 5:
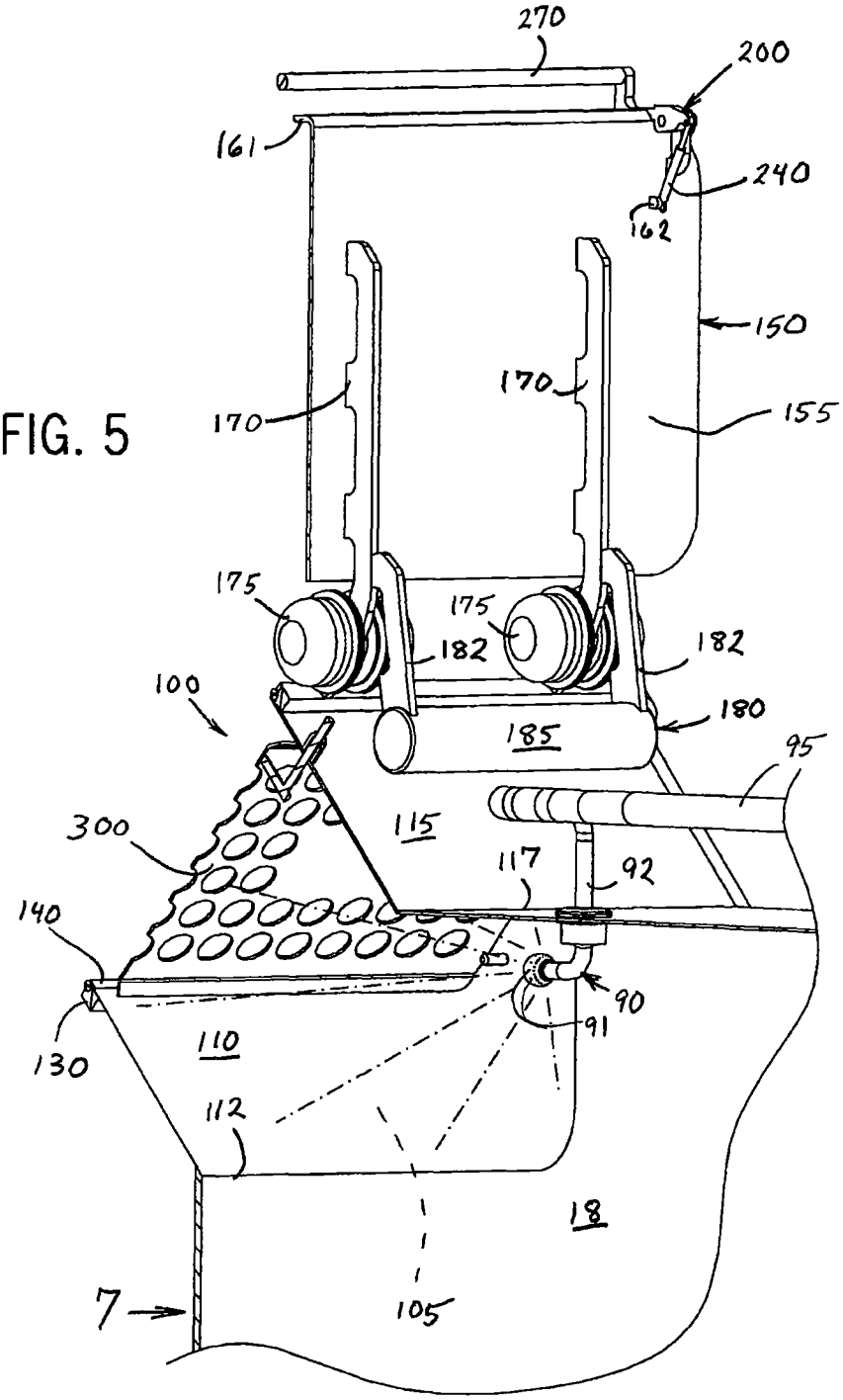
FIG. 5 is a partially cut away isometric view of a manway of FIG. 3, taken at line 5-5 of FIG. 3.
Figure 6:
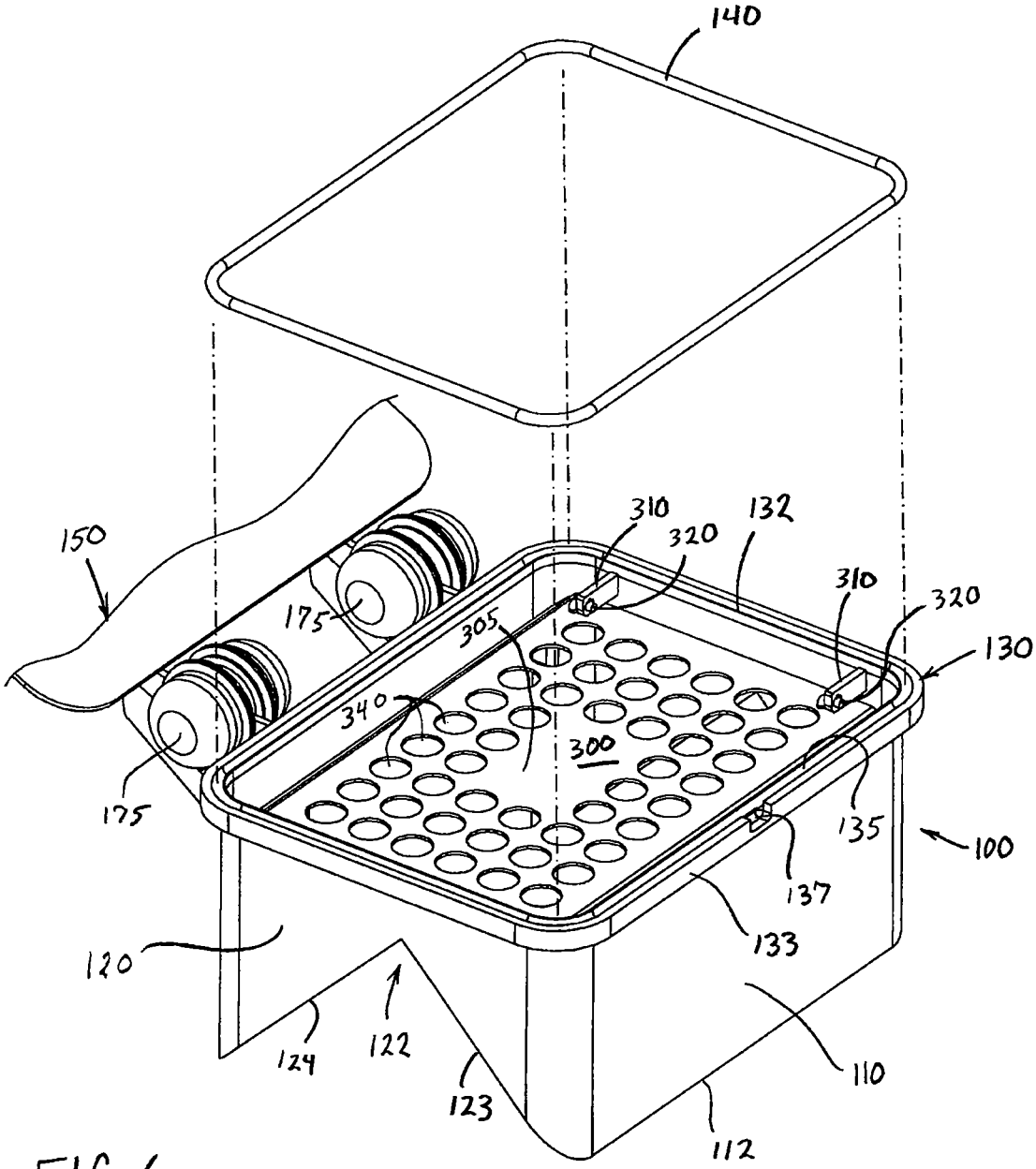
FIG. 6 is a partially exploded isometric view of that manway of the vat system of FIG. 1.
Figure 7:
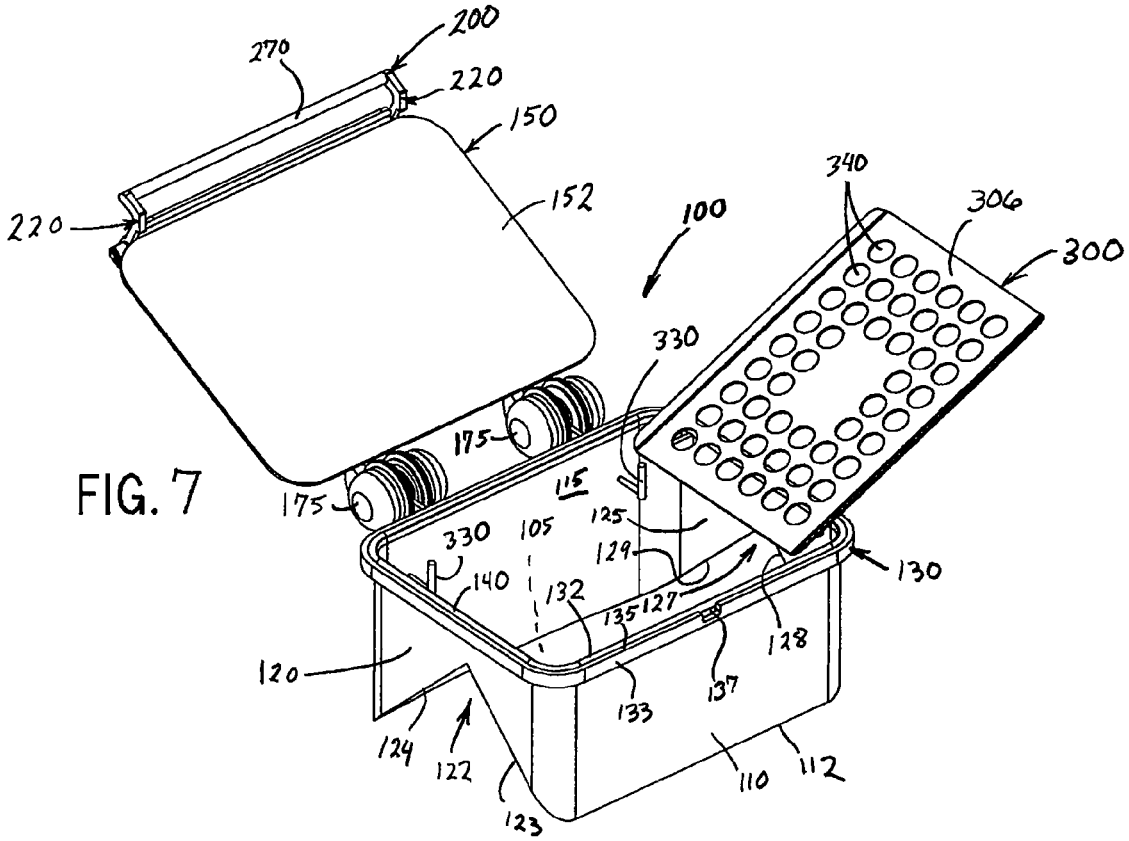
FIG. 7 is an isometric view of the manway of the vat system of FIG. 1.

Referring now to FIGS. 5, 6, and 7, in this embodiment manway 100 includes interconnected walls, namely lower wall 110, upper wall 115, and opposing side walls 120, 125 that connect to and extend from the vat 7. A passage 105 extends longitudinally through the manway 100, between the lower, upper, and side walls 110, 115, 120, 125, respectively, and extends into the inside space 8 of the vat 7. In this embodiment, the manway 100 connects to the vat 7 at an intersection between the top and end walls 10, 18, respectively. Lower wall 110 of the manway 100 connects at its lower edge 112 to the vat end wall 18. Upper wall 115 connects at its lower edge 117 to the vat top wall 10. Side walls 120, 125 connect to both the end wall top and end walls 10, 18, respectively, of the vat 7. The side walls 120, 125 have V-shaped cutouts 122, 127 with lower edges 123, 128, respectively, that are connected to the vat end wall 18. Upper edges 124, 129 of the V-shaped cutouts 122, 127, respectively, connect to the vat top wall 10, which arranges the manway 100 angularly with respect to the vat 7 so that the passage 105 extends angularly into the inside space 8 of the vat 7.

Referring now to FIG. 5, a nozzle 90 is positioned with respect to the vat system 5 so that its opening(s) 91 directs cleaning fluid into the manway 100. In this embodiment, the nozzle 90 is mounted to the top wall 10 of the vat and has opening(s) 91 provided about its outer surface so as to direct cleaning fluid in multiple directions, so that some of the cleaning fluid enters the passage 105 from below and is directed across the various inwardly facing surfaces of the manway 100. In another embodiment, the nozzle 90 may be mounted directly to the manway 100, or on another part of the vat 7, such as the end wall 18, with the opening(s) 91 facing into the passage 105. A nozzle tube 92 connects the nozzle 90 to a cleaning fluid supply line 95 that is connected to a known clean-in-place system (including suitable plumbing components, hardware components, and controls) that is configured to deliver cleaning fluid for automatically spraying down predetermined surfaces within the vat system 5.

Referring now to FIGS. 6 and 7, manway 100 includes a flange 130 that connects the lower, upper, and side walls 110, 115, 120, 125, respectively, at respective upper portions and has an upper surface 132 with a groove 135 that extends into the upper surface 132 and about the entire perimeter of the flange 130. Groove 135 is configured to hold a seal 140 in it while allowing the seal 140 to be removed and replaced. A recess 137 extends through a front surface 133 and the upper surface 132 of the flange 130, and is connected to the groove 135. The recess 137 is sized to accommodate a finger of a technician, which allows the technician to manually remove the seal 140 from the groove 135 without using tools. Shown best in FIGS. 15 and 16, the seal 140 engages a lower surface 152 of a lid 150 to provide a substantially liquid-tight interface between the flange 130 and lid 150.

Referring now to FIGS. 7-10, lid 150 has an upper surface 155 facing in a direction opposite that of the lower surface 152, and defines a front end 160 and a back end 165. The front end 160 is provided nearest the lower wall 110 of the manway 100 and the back end 165 is provided nearest the upper wall 115 of the manway 100. A pair of lid brackets 170 attaches to the upper surface 155 of the lid 150 and extends outwardly beyond the back end 165. A pair of spring hinges 175 is connected to the upper wall 115 and the lid brackets 170 connect to the spring hinges 175, so that the spring hinges 175 assist in the pivotal lifting and lowering of the lid 150 away from and toward flange 130, respectively.

Figure 8:
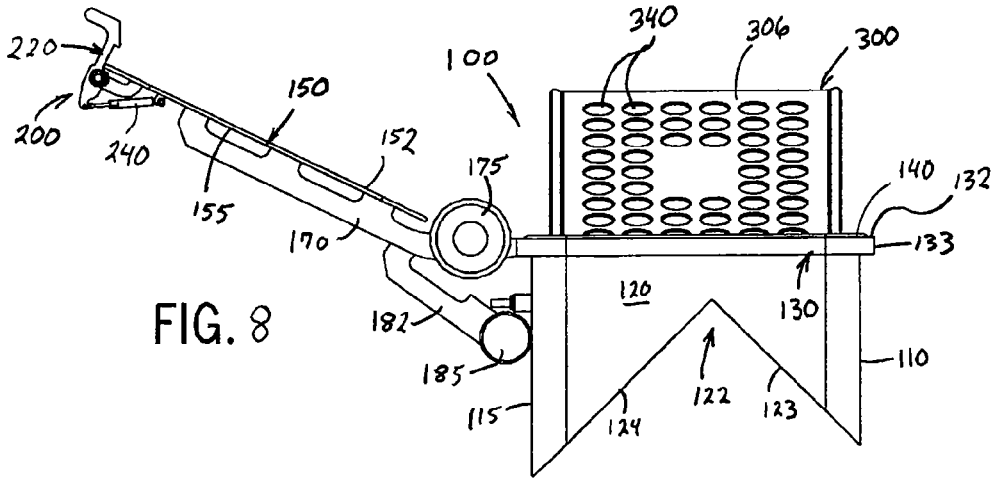
FIG. 8 is a side elevation of the manway of FIG. 7.
Figure 9:
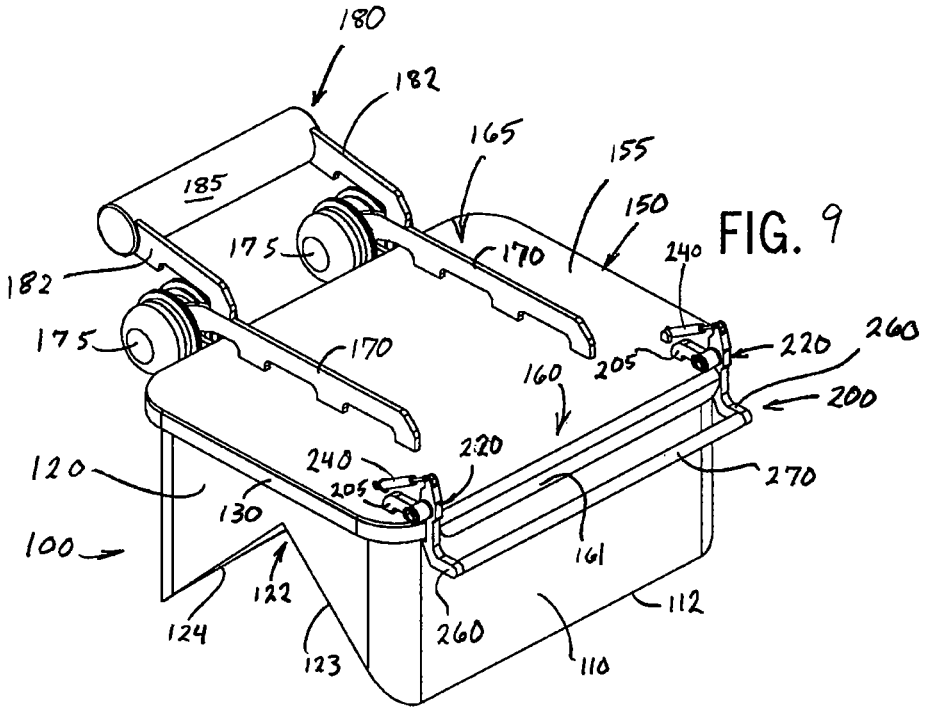
FIG. 9 is a side elevation of the manway of FIG. 7.
Figure 10:
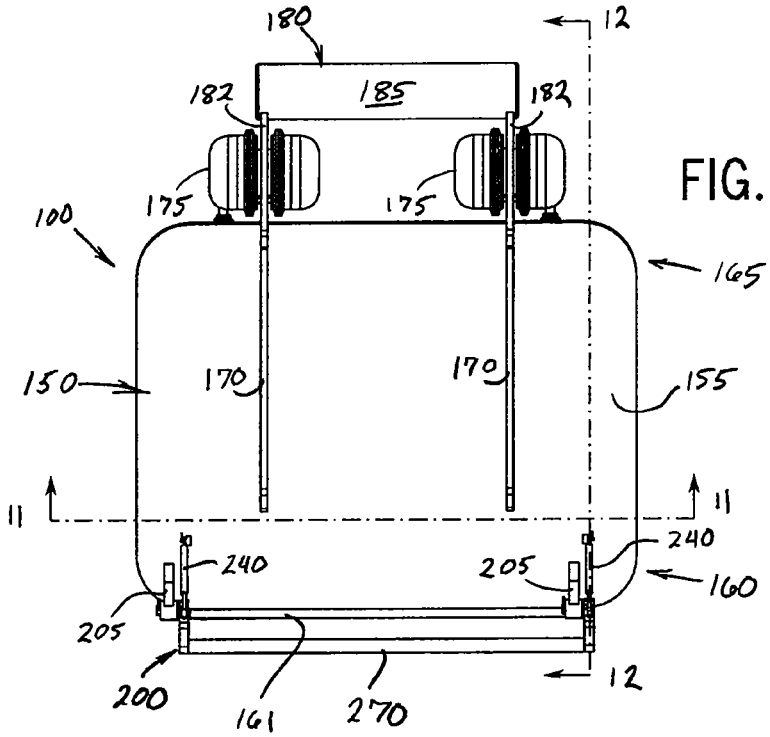
FIG. 10 is a top plan view the manway of the vat system of FIG. 1.
Figure 11:
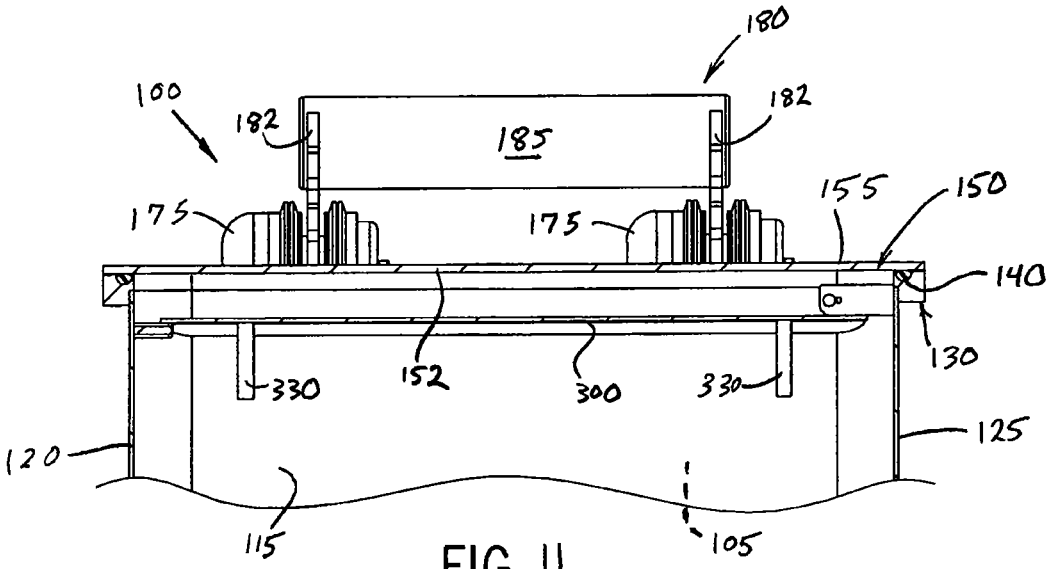
FIG. 11 is a sectional view of the manway of FIG. 10, taken at line 11-11 of FIG. 10.
Figure 12:
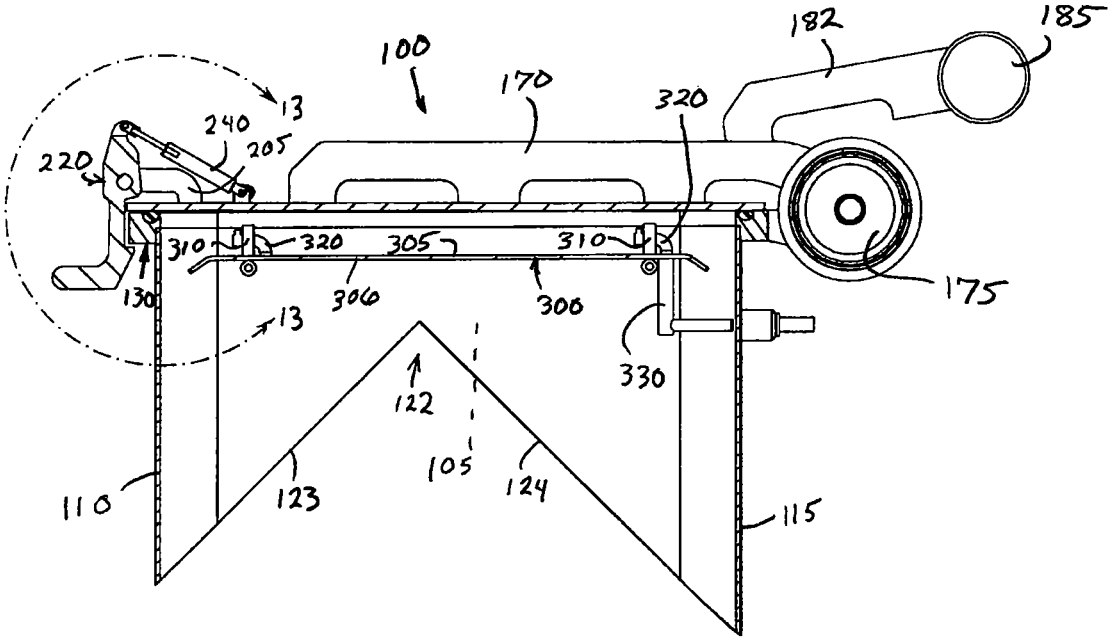
FIG. 12 is a sectional view of the manway of FIG. 10, taken at line 12-12 of FIG. 10.

Referring now to FIGS. 8-10, a stop 180 is connected to the lid 150 and is configured to limit the travel of the lid 150 while opening the lid 150 and holding the lid 150 in an open position (FIGS. 5 and 8). Stop 180 includes a pair of stop brackets 182 that are connected to the lid brackets 170 adjacent the back end 165 of the lid 150. The stop brackets 182 extend from the lid brackets 170 over and beyond the spring hinges 175 so that outer ends 184 of the stop brackets hold a stop tube 185 in a cantilevered manner from the lid brackets 170. Since the cantilevered stop tube 185 is positioned on an opposing side of the spring hinges 175 than the lid 150, the stop tube 185 provides a counter-weight to the lid 150 that assists in the pivotal lifting and lowering of the lid 150 with respect to the flange 130, between the open and closed positions. The closed position in which the lid 150 covers the passage 105 is shown in FIGS. 9-12, whereas the open position in which the lid 150 is pivoted away from the passage 105 so that the passage 105 is uncovered is shown in FIGS. 5-8.

Referring now to FIGS. 9 and 12-14, a latch system 200 is mounted to the front end 160 of the lid 150. The latch system 200 includes a pair of latch brackets 205 that extends upwardly from the upper surface 155 and outwardly across the front end 160 to a location that is generally aligned with a lip 161 (FIGS. 9 and 14) that extends downwardly in front of and slightly below the front surface 133 of the flange 130.

Figure 13:
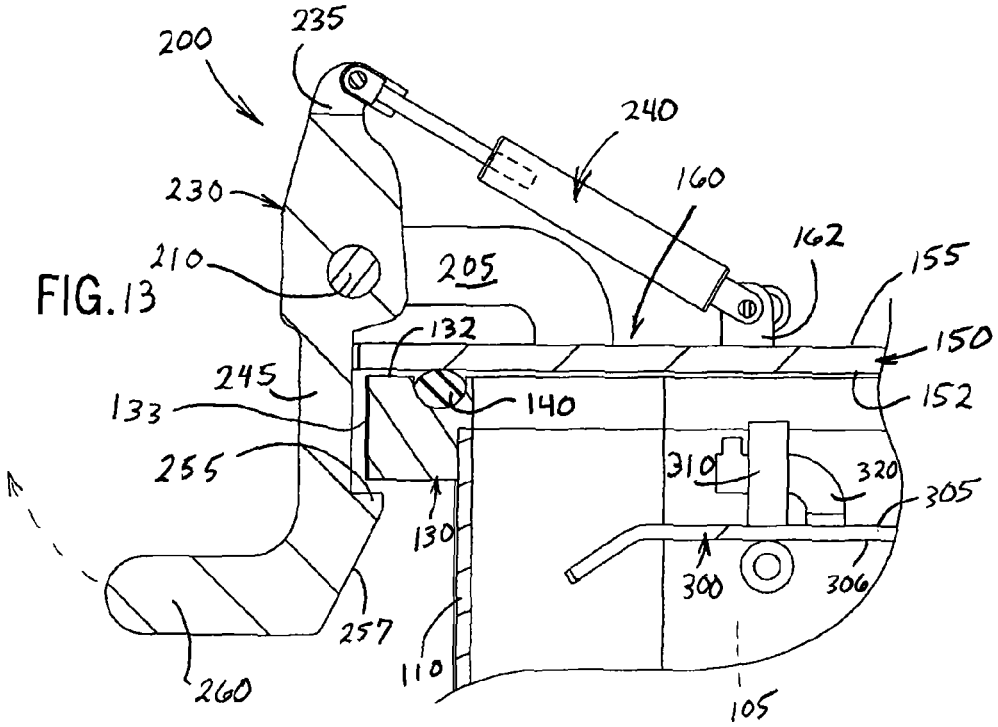
FIG. 13 is a sectional view of a latch system of the manway of FIG. 12, taken at the curved line 13-13 of FIG. 12.
Figure 14:
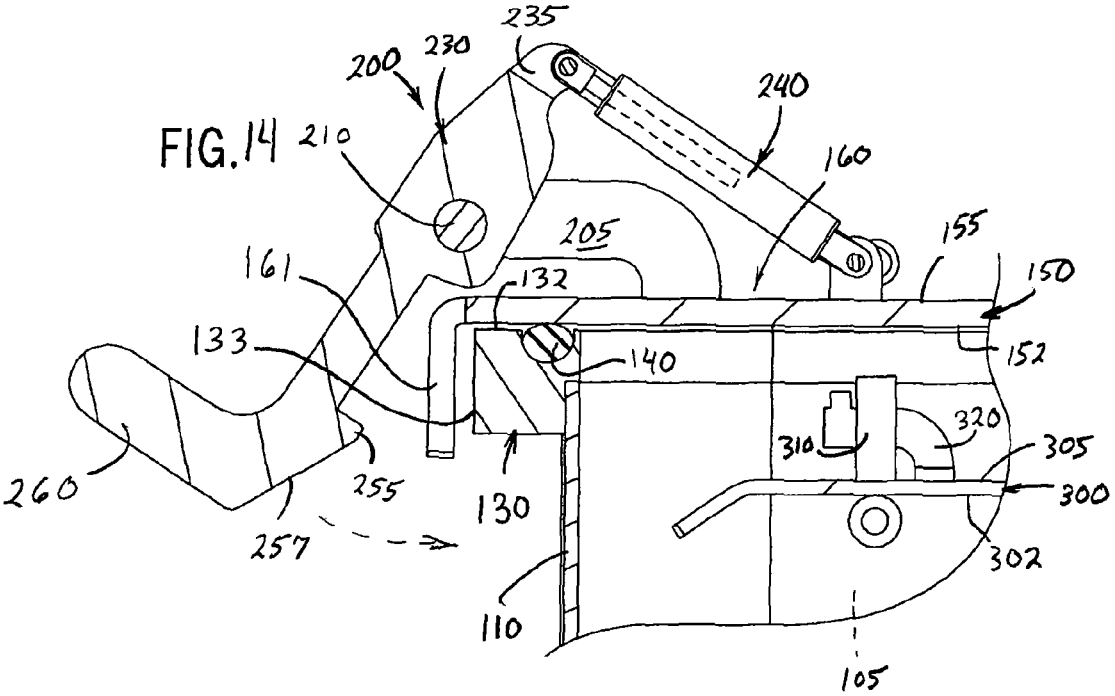
FIG. 14 is another sectional view of the latch system of the manway of FIG. 12.

Referring now to FIGS. 13 and 14, each latch bracket 205 includes a pin 210 that extends transversely through a latch 220 and about which the latch 220 can pivot. The pin 210 extends through a bore 225 that is provided in an upper end 230 of the latch 220. The upper end 230 includes a tab 235 that is positioned above the bore 225 and to which a first end of a closer 240 is attached. A second end of the closer 240 is connected to a lid tab 162 that extends upwardly from the upper surface 155 of the lid 150 at the front end 160. Closer 240 is shown as a gas or hydraulic spring device, although it is understood that the closer 240 may incorporate a helical spring or other biasing member that can bias the latch 220 from an unlocked position shown in FIG. 13 to the locked position shown in FIG. 14, so that the resting state position of the latch 220 is the locked position of FIG. 14.

Still referring to FIGS. 13 and 14, the latch 220 includes an intermediate segment 245 that extends between the upper end 230 and a lower end 250. The intermediate segment 245 is narrower than both the upper and lower ends 230, 250. A step change in width of the latch 220 is defined at a transition between the intermediate segment 245 and lower end 250, at a shoulder 255 that extends from the lower end 250 toward the lower wall 110 of the manway 100. When the latch 220 is in the locked position shown in FIG. 14, the shoulder 255 extends under the flange 130. The locked position of the latch 220 correspondingly allows the shoulder 255 to engage the flange 130 to mechanically prevent further movement of the lid 150 in an upwardly pivoting direction. A ramp 257 extends angularly from a bottom end 251 of the lower end 250 and connects to the shoulder 255. The ramp 257 is configured to self-lock the latch 220 during closing of the lid 150 by sliding across the flange 130 to deflect the lower end 250 away from the lower wall 110 until the shoulder 255 advances past the flange 130, at which point the closer 240 biases the latch 220 to the closed position.

Referring now to FIGS. 9, 13, and 14, legs 260 extend from the lower ends 250 of the latch 220, away from the lower wall 110 of the manway 100. A handle 270 is connected at its ends 272, 274 to the legs 260 of the latch 220. This allows movement of the handle 270 in an outward direction away from the flange 130 to be translated to movement of the shoulder 255 away from the flange 130, pivoting the latch 220 about the pin 210 and moving the latch 220 from the locked position (FIG. 13) to the unlocked position (FIG. 14) against the resisting force of the closer 240 that tends to bias the latch 220 back toward the locked position. The latch system 200 can thus be operated with a single hand of a technician and in combination with the stop 180 and/or spring hinges 175, allowing the technician to fully operate the lid 150 so as to lock, unlock, raise, and lower the lid 150 with a single hand.

Referring again to FIGS. 6 and 7, when the lid 150 is in the open position, a grate 300 can be positioned over the passage 105 or moved away from the passage 105 for preventing or permitting access through the passage 105, respectively. Shown best in FIG. 6, a pair of grate tabs 310 extends from the flange 130 into the passage 105. Grate pins 320 extend upwardly from an upper surface 305 of the grate 300 and bend so as to extend transversely through the grate tabs 310, allowing pivoting movement of the grate 300 about the pins 320. In this embodiment, the tabs 310 and pins 320 are arranged so that the grate 300 and lid 150 pivot in different directions orthogonally, with respect to each other. When the grate 300 is pivoted upwardly to an open position such as that shown in FIG. 7, the upper surface 305 rests against the flange 130 and the grate 300 extends outwardly away from and at an angle with respect to the passage 105. When the grate 300 is pivoted downwardly to a closed position such as that shown in FIG. 6, a bottom surface 306 of the grate 300 sits upon posts 330 (FIG. 6) that extend into the passage 105 from the upper wall 115. Multiple openings 340 extend through the grate 300 to allow visual inspection of the inside space 8 of the vat without allowing access through the passage 105. This may be achieved by, for example, providing a ladder or staircase and platform (not illustrated) that is positioned adjacent the end wall 18 and provides a surface upon which a technician may stand while allowing the technician to look through the openings 340 of the grate 300.

Various alternatives and embodiments are contemplated as being within the scope of the following claims particularly pointing out and distinctly claiming the subject matter regarded as the invention.

We claim:

1. A food processing vat system comprising: a vat defining a vat enclosure with multiple interconnected vat walls defining an inside space threbetween, wherein the multiple interconnected vat walls include a top wall and at least one side wall that defines a vat wall intersection; a manway having interconnected manway side walls with respective inwardly facing surfaces collectively defining a passage threbetween, the manway being arranged angurlarly with respect to the top wall of the vat and connected to the vat so that the passage of the manway extends angularly into the inside space of the vat, wherein the manway extends across the vat wall intersection with a first portion of the manway engaging the top wall of the vat and a second portion of the manway engaging the at least one said wall of the vat; and a nozzle being configured to convey a cleaning fluid therethrough and monted to at least one of the manway and the vat, the nozzle having an opening that is positioned with respect to the manway and configured to direct the cleaning fluid onto the inwardly facing surfaces of the manway.

2. The food processing vat system of claim 1, wherein the nozzle is positioned at least partially within the passage of the manway.

3. The food processing vat system of claim 2, the manway further comprising a lid that defines a closed position in which the passage is covered and an open position in which the passage is uncovered, and a grate having multiple openings that can extend across the passage when the lid is in the open position.

4. The food processing vat system of claim 3, wherein both the lid and the grate can pivot away from the passage to permit access into the inside space of the vat.

5. The food processing vat system of claim 1, wherein the manway extends away from the vat so that (i) an upper portion of the manway extends above the top wall of the vat, and (ii)

a lower portion of the manway extends outwardly with respect to at least one of the interconnected vat walls.

6. The food processing vat system of claim 1, the manway further comprising a lid that defines a closed position in which the passage is covered and an open position in which the passage in uncovered, and a stop that is connected to the lid for holding the lid in the open position.

7. The food processing vat system of claim 6, wherein the stop holds the lid in the open position so that the lid is situated generally orthogonally with respect to the top wall of the vat.

8. The food processing vat system of claim 6, the manway further comprising a spring hinge connecting the lid to at least one of the manway side walls, wherein the spring hinge is configured for pivoting the lid between the closed and open positions and that assisting pivoting the lid between the closed and open positions.

9. The food processing vat system of claim 8, wherein the stop and the lid are arranged on opposing sides of the spring hinge and wherein the stop is configured as a counter-weight to the lid that assists pivoting the lid between the closed and open positions.

10. The food processing vat system of claim 1, the manway further comprising a lid that defines a closed position in which the passage is covered and an open position in which the passage is uncovered, and a latch that can move between a locked position that locks the lid in the closed position and an unlocked position that allows the lid to move from the closed position to the open position, the latch biasing toward the locked position.

11. The food processing vat system of claim 10, the manway further comprising a handle that is connected to the latch so that moving the handle between a locked position and an unlocked position of the handle correspondingly moves the latch between the locked position and unlocked position of the latch.

12. The food processing vat system of claim 1, wherein the manway includes a lid that defines a closed position in which the passage is covered and an open position in which the passage in uncovered, and a seal that is provided between the interconnected walls and the lid.

13. The food processing vat system of claim 12, wherein the seal is seated in a groove that extends about upper surfaces of the manway side walls, at least one of the manway side walls including a recess that extends into the respective upper surface and connects to the groove so that the recess accommodates manual tool-less removal of the seal from the groove.

* * * * *

UNITED STATES PATENT AND TRADEMARK OFFICE

CERTIFICATE OF CORRECTION

PATENT NO. : 9,114,437 B2
APPLICATION NO. : 13/089052
DATED : August 25, 2015
INVENTOR(S) : Timothy J. Isenberg et al.

It is certified that error appears in the above-identified patent and that said Letters Patent is hereby corrected as shown below:

IN THE CLAIMS

Claim 1, column 6, line 48, delete "monted" and substitute therefor -- mounted --

Signed and Sealed this
Twenty-ninth Day of December, 2015

Michelle K. Lee

Michelle K. Lee
*Director of the United States Patent and Trademark Office*